US005225623A

United States Patent [19]

Krasnow

[11] Patent Number: 5,225,623

[45] Date of Patent: Jul. 6, 1993

[54] SELF-DEFENSE DEVICE

[76] Inventor: Philip Krasnow, 2359 E. 16th St., Brooklyn, N.Y. 11229

[21] Appl. No.: 644,875

[22] Filed: Jan. 23, 1991

Related U.S. Application Data

[63] Continuation of Ser. No. 464,356, Jan. 12, 1990, abandoned.

[51] Int. Cl.[5] ..... F41B 15/04

[52] U.S. Cl. ..... 89/1.1; 89/1.11

[58] Field of Search ..... 89/1.1, 1.11; 239/150, 239/163, 332

[56] References Cited

U.S. PATENT DOCUMENTS

| | | | |
|---|---|---|---|
| 1,497,244 | 6/1924 | Mattox | 239/150 |
| 2,331,388 | 12/1943 | Graham | 89/1.11 |
| 2,586,256 | 2/1952 | Quarles | 239/150 |
| 2,851,094 | 9/1958 | Griffin | 89/1.1 |
| 3,374,708 | 3/1968 | Wall | 89/1.11 |
| 3,971,292 | 7/1976 | Paniagua | 89/1.11 |
| 4,154,375 | 5/1979 | Bippus | 239/332 |
| 4,443,906 | 4/1984 | Tucker et al. | 15/50 R |
| 4,518,118 | 5/1985 | Takata | 239/163 |
| 4,684,062 | 8/1987 | Bagwell | 239/332 |
| 4,704,942 | 11/1987 | Barditch | 89/1.11 |
| 4,846,044 | 7/1989 | Lahr | 89/1.11 |
| 4,852,454 | 8/1989 | Batchelder | 89/1.11 |
| 4,930,392 | 6/1990 | Wilson | 89/1.11 |
| 5,054,959 | 10/1991 | Wilson et al. | 239/150 |

*Primary Examiner*—David H. Brown

[57] ABSTRACT

A self-defense device comprises a housing defining first and second fluid ejection orifices, at least a fluid reservoir, a fluid path from the reservoir to the orifice, a power source in electrical conducting relation with the fluid path for imparting an electrical charge to conductive fluid in the fluid path, and a mechanism for forcing fluid from the reservoir through the orifice for ejecting electrically charged continuous first and second fluid streams at a target.

21 Claims, 4 Drawing Sheets

FIG.3a
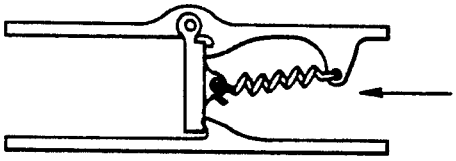
FIG.3b
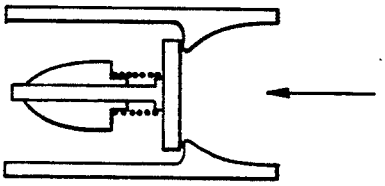
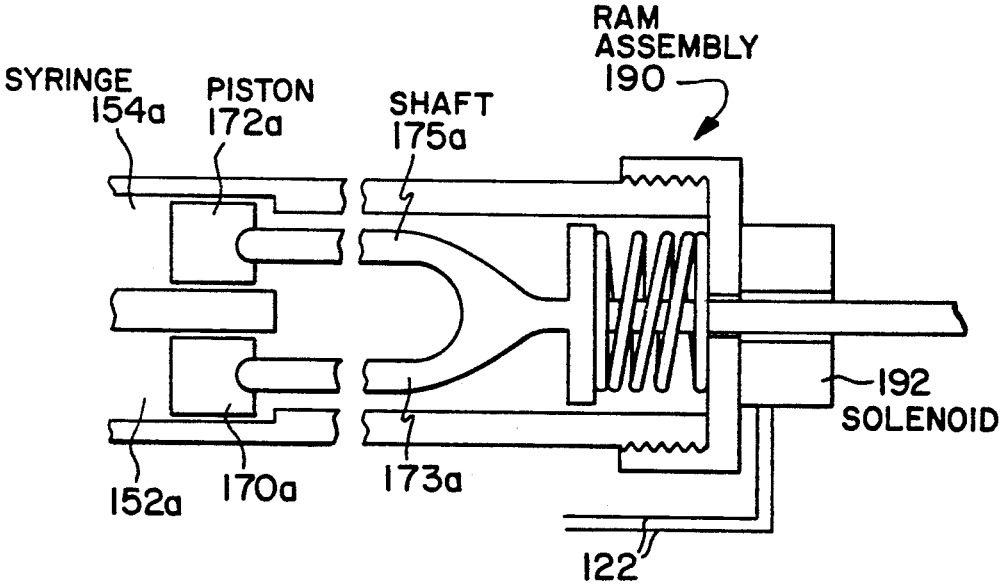
FIG.4

SELF-DEFENSE DEVICE

This is a continuation of applicant's prior application Ser. No. 464,356, filed Jan. 12, 1990, now abandoned.

BACKGROUND OF THE INVENTION

1. Field of the Invention

This invention pertains to self-defense devices, and more particularly to a device adapted to stun an assailant by projecting an electrically charged fluid.

2. Prior Art

Various non-lethal self-defense weapons exist in the prior art. For example, hand held devices capable of delivering an electric charge to an assailant are well known. However, such devices require the user to be in close proximity to the assailant for contacting the assailant with a high voltage element on the device. For obvious reasons, this is undesirable. U.S. Pat. No. 4,034,497 to Yanda discloses a self-defense device having a reservoir of liquid which is heated by detonation of a cartridge prior to projection at an assailant. While this device allows the user to maintain a safe distance from the assailant, heated liquid is not perceived as effective a deterrant as an electric shock.

It is, therefore, an object of the present invention to provide a self-defense device which allows the user to electrically shock an assailant while maintaining a safe distance from the assailant and protecting the user from shock.

It is a further object of the invention to provide a reliable self-defense device which projects an electrically charged fluid at an assailant for stunning the assailant thereby repelling an attack.

A further object of the invention is to provide a self-defense device which employs a high voltage electrical source in combination with an electrically conductive fluid to provide a desired stun effect.

A still further object of the present invention is to provide a stun gun which is convenient to handle and which maximizes the electrical potential transferrable to the target.

Still another object of the invention is to provide a portable device which projects a fluid stream, or dual fluid streams, light emitting in transit to, or upon contact with, a target.

SUMMARY OF THE INVENTION

The present invention provides a self-defense device comprising at least a fluid reservoir; first and second fluid ejection nozzles; means for conducting fluid from the fluid reservoir to the nozzle, said fluid reservoir, said fluid conducting means and said nozzles defining first and second fluid paths; a current generating means in electrical communication with the fluid path for charging fluid and means for producing high voltage therefrom in the fluid path; and means for forcing fluid from the reservoir through the nozzle for ejecting electrically charged first and second fluids at a target.

These as well as further objects and advantages of the present invention will be more fully apparent from the following detailed description and annexed drawings.

BRIEF DESCRIPTION OF THE DRAWINGS

In the drawings, wherein like numerals represent like parts:

FIG. 3(*a*) and FIG. 3(*b*) are views of typical flap valves; and

FIG. 4 is a view of a modification of the fluid ejection means of FIG. 3.

DETAILED DESCRIPTION OF THE PREFERRED EMBODIMENTS

Figure 1:
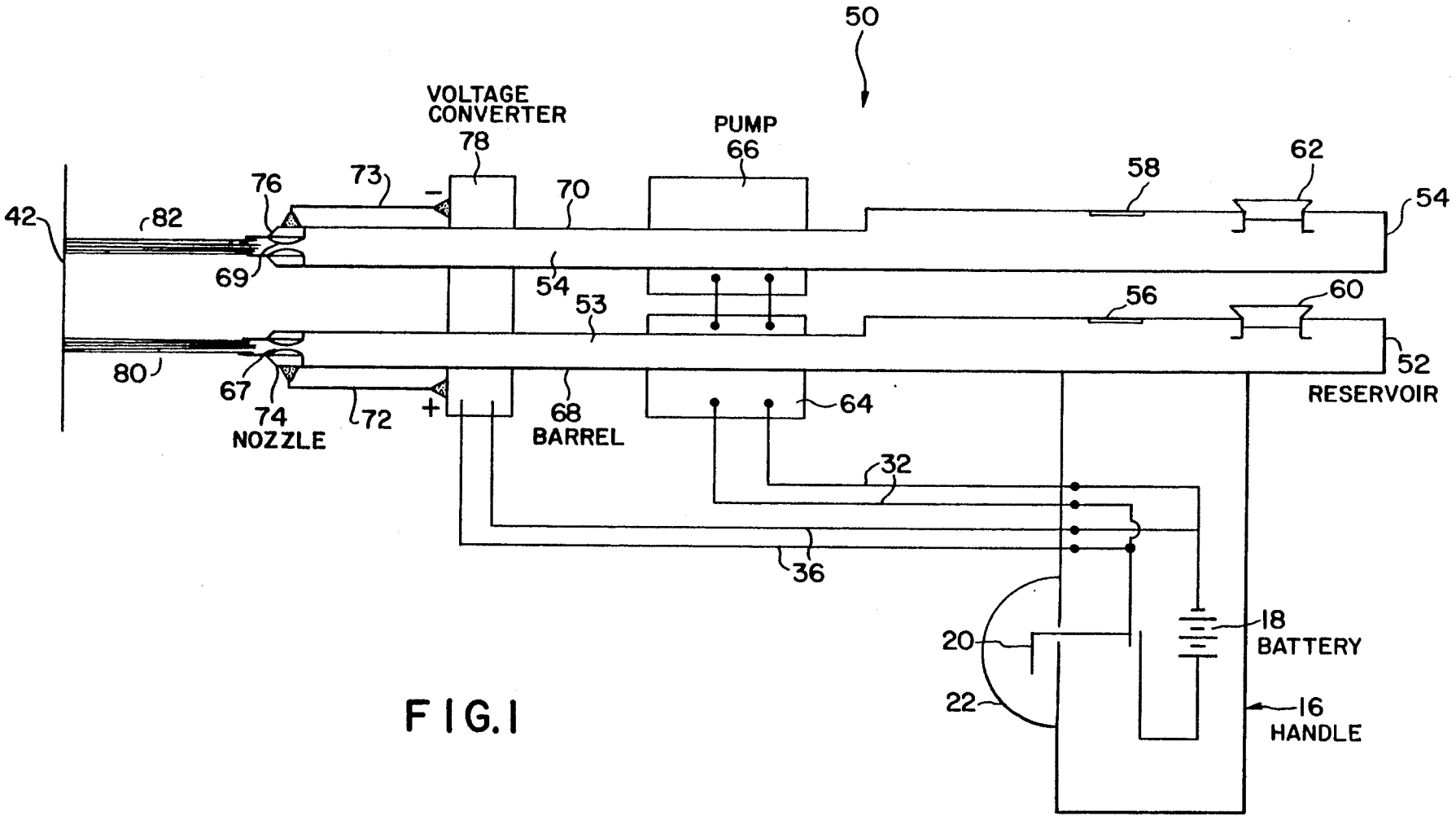
FIG. 1 is a partly schematic, partly diagrammatic view of a first embodiment of a stun gun in accordance with the invention having two fluid reservoirs, two barrels and two pumps.

A stun gun in accordance with the present invention generally includes one or two reservoirs having a filling port for introducing a fluid, preferably liquid, and a one-way vent for maintaining air pressure on the liquid as the reservoir level drops. A handle portion includes a battery power supply, a trigger-style on-off switch for accessing the power supply, and a trigger guard. Each of two barrels communicates at its proximal end with a reservoir and at its distal end with a nozzle, the reservoir, barrel and nozzle collectively defining a fluid path. The nozzle is metal and preferably includes a venturi orifice. The stun gun will typically have a high voltage source mounted on the barrel and will include a housing comprised, for example, of electrically non-conductive polypropylene, to house the parts illustrated and to protect the user from electric shock. The housing may, for example, have a conventional "hand gun" shape.

An electrically activated fluid pump for pumping fluid from the reservoir mounted on the barrel is connected to the battery by wires. The pump optionally includes a gate retractable when the pump is activated for blocking the fluid path and sealing the liquid in the reservoir when the switch is in its off, undepressed state. When the pump is activated upon depression of the switch, the pumping action propels liquid from the reservoir through the fluid path for ejection under pressure via the venturi orifice and for this purpose any suitable liquid pump will suffice.

As shown in the embodiments illustrated herein, a voltage converter mounted on the barrel between reservoir and nozzle is electrically connected to the battery by wires and serves to amplify the direct current low voltage from the battery to a high voltage when the switch is depressed. The high voltage output from the voltage converter is connected via wires to the metal nozzles for imparting the high voltage at one potential to one nozzle and at a different potential to the other nozzle and, thereby, to the liquids exiting therethrough.

Any fluid or combination of fluids is suitable provided it is electrically conductive and suitable for ejection through a nozzle as a continuous fluid stream, thereby transferring the electrical potential at the nozzle to the target. Examples of suitable fluids include metallic liquid mercury and/or any fluid, gel, or paste containing a sufficient concentration of electrically conductive particles, e.g. graphite, metallic or superconductive particles suspended within a preferably nonflammable base. Alternatively, a soluble salt or combination thereof (e.g. lithium bromide, aluminum sulfate, magnesium chloride, ammonium sulfate, aluminum chloride, common table salt, etc.) which ionizes sufficiently within a fluid (e.g. dimethyl sulfoxide, propylene carbonate, water, glycerine, electrorheologic fluid, polyacrylamide, carboxymethyl cellulose, guar gum, other thixotropic gels and polyelectrolytes) may be used.

The operation of the stun gun will by now be apparent. Briefly, depression of the trigger establishes a current path from the battery to the voltage converter and pump means. The high voltage output from the voltage converter is applied via wires to the two metallic nozzles for electrically charging liquid flowing through each nozzle with a different potential. The application of current to the pump activates the pump for pumping liquid from the reservoir through the venturis, with the liquid being electrically charged as it contacts the nozzle before exiting via the venturi as a continuous stream. It will be apparent that as the two liquid streams strike the target, typically an assailant, a current path is established comprising one nozzle, the fluid stream therefrom, the assailant, the fluid stream from the other nozzle and the other nozzle. The resulting electrical "shock" to the body of the assailant is intended to repel the assailant, or at least to briefly stun the assailant thereby allowing the victim to take other steps to extricate himself/herself from the attack. Of course, it is important that the liquid streams projected from the nozzles remain continuous between the nozzle and the target, as any discontinuity will preclude the establishment of an electric current path at the target. A continuous liquid stream is assured by appropriate selection of the viscosity and density of the fluid, selection of an appropriate pump, and proper dimensioning of the venturi.

It will be apparent that the self-defense device of the present invention allows the user to maintain a reasonable distance from the assailant while imparting a highly effective electric shock as a deterrent. This combination, which is equally applicable to the embodiments discussed herein, renders the device of the invention particularly suited for use as a self-defense device.

FIG. 1 illustrates a first embodiment of the present invention, generally designated at 50 which projects dual liquid streams, each at a different high voltage electrical potential. As shown, the device 50 includes dual reservoirs 52, 54 having the usual vents 56, 58 and filling ports 60, 62, respectively. The reservoirs 52, 54 are connected, respectively, to barrels 68, 70 having metal nozzles 74, 76 at their distal ends. Thus a first fluid path 53 comprises reservoir 52, barrel 68 and nozzle 74, and a second fluid path comprises reservoir 54, barrel 70 and nozzle 76. Device 50 also includes suitable dual pumps 64, 66 connected in tandem and a voltage converter 78 connected via wires 72, 73 to metal nozzles 74, 76, for simultaneous activation from battery 18 via wires 32 and 36, respectively upon depression of switch 20 shown behind trigger guard 22. More specifically, the nozzle 74 is connected by wire 72 to the positive terminal of the voltage converter 78 and the nozzle 76 is connected by wire 73 to the negative terminal. Consequently, upon liquid discharge, the liquid streams 80, 82 ejected from the nozzles 74, 76 are at different potentials. In this embodiment, the pump employed does not require a retractable gate.

In use, when the switch 20 is depressed, pumps 64, 66 pump liquid from the reservoirs 52, 54 through dual barrels 68, 70 to metal nozzles 74, 76. Because of the close proximity of the barrels 68, 70, it will be apparent that the dual streams 80, 82 exiting nozzles 74, 76, respectively, will be in close proximity as they strike the assailant target 42. Consequently, an electric current path will be established between the streams through the intervening portion of the assailant's body. As the resistance will be relatively low, the resulting current flow at the assailant's body will be high, and hence effective for its purpose. Nozzles 74, 76 may include venturis 67, 69 set on an angle to direct liquid streams 80, 82 to achieve optimal distances between liquid streams 80, 82 when they contact the target.

Figure 2:
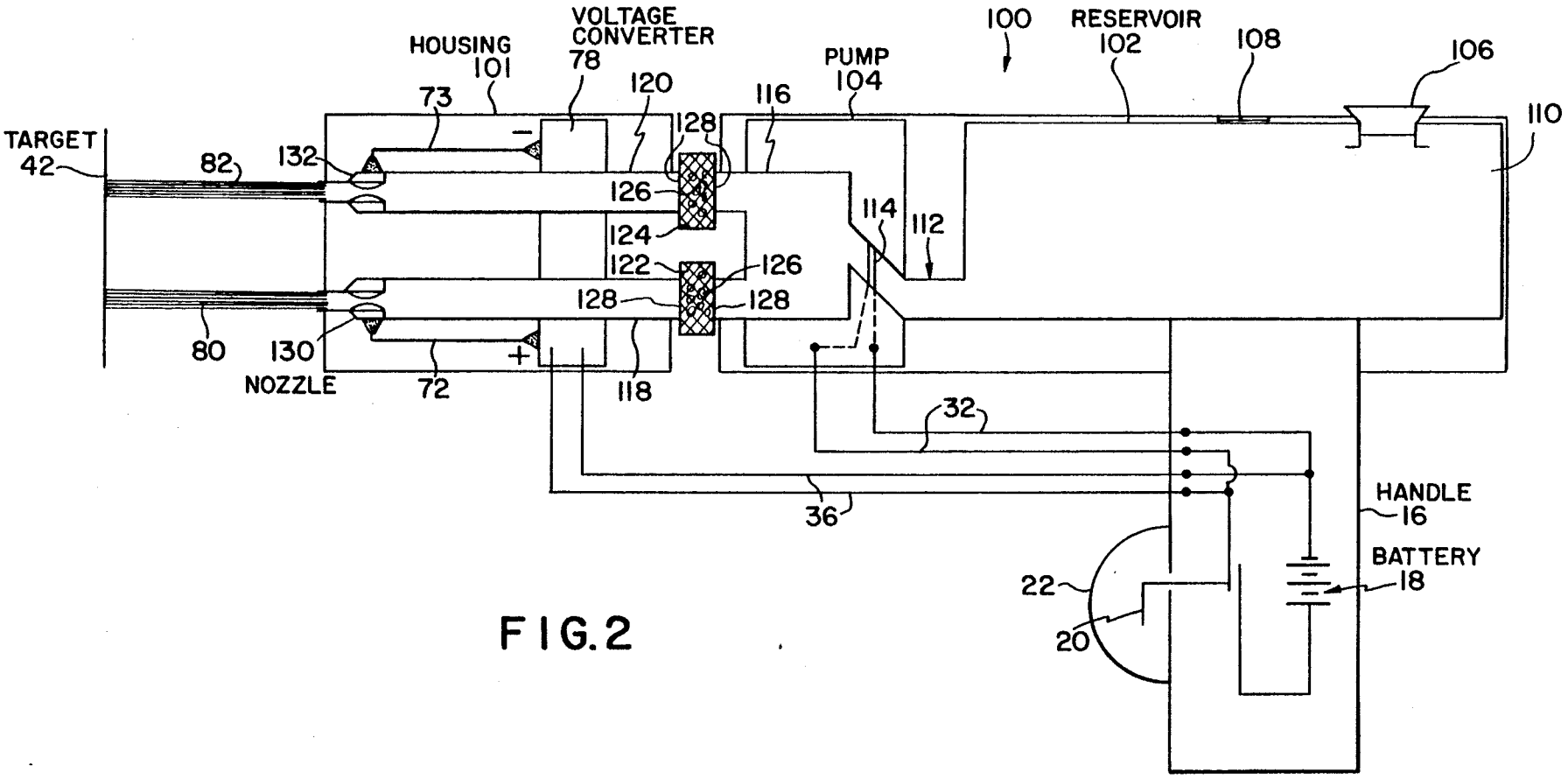
FIG. 2 is another such view showing an embodiment of a stun gun having a single reservoir, two barrels and a single pump.

FIG. 2 illustrates a second embodiment 100 of the stun gun which, like the embodiment of FIG. 1, generates dual liquid streams, but does so with a single fluid reservoir 102 and a single pump 104. As shown, fluid reservoir 102 has the usual filling port 106 and vent 108. However, unlike the embodiment described hereinabove, the reservoir 102 is filled with a non-conducting fluid 110 rather than a conducting fluid. A conduit 112 connects the reservoir 102 to the pump 104, and a gate 114 in the conduit 112 retains the fluid 110 in the reservoir, except when the trigger 20 is depressed whereupon the gate 114 is retracted. As shown, the pump 104 includes chamber 116 having dual outlets to barrels 118, 120 having chambers 122 and 124, respectively, at their proximal ends. Screens 128 on either side of the chambers 122, 124 retain electrolyte material, e.g. pellets, 126 therein while accommodating liquid flow therethrough.

In use, upon depression of switch 20, pump 104 pumps fluid 110 from the reservoir 102 through the dual outlets of chamber 116 to the electrically separated barrels 118, 120. As the fluid 110 passes through the chambers 122, 124, the pellets 126 dissolve thereby rendering the fluid streams in the barrels 118, 120 ion permeable and hence electrically conductive. As the now conductive streams flow through their respective nozzles 130, 132, they are electrically charged via wires 72, 73 from voltage converter 78 in the manner described above in connection with the embodiment of FIG. 1, i.e., the dual liquid streams 80, 82 ejected from the nozzles 130, 132 are at different potentials, e.g. positive and negative, respectively. The resulting stun effect to the target 42 is likewise as described above in connection with the embodiment of FIG. 1. Typically, an electrically non-conductive housing 101 covers the nozzles and protects the user from electric shock. The housing may, for example **101*a*, also cover the reservoir, power source and fluid forcing means and be adapted to be hand held. The housing may have a conventional "hand gun" shape. Wires 32 and 36** may be located inside of the housing.

From the foregoing, it will be apparent that the stun gun 100 of FIG. 2 may employ a single reservoir 102 and a single pump 104 because the liquid 110 is not rendered conductive until after it has been separated into dual streams and is in the barrels 118, 120, i.e., after contacting the pellets 126 in chambers 122, 124. Of course, if the stun gun 100 is intended for repetitive use, an access must be provided for replacing the pellets 126.

Figure 3:
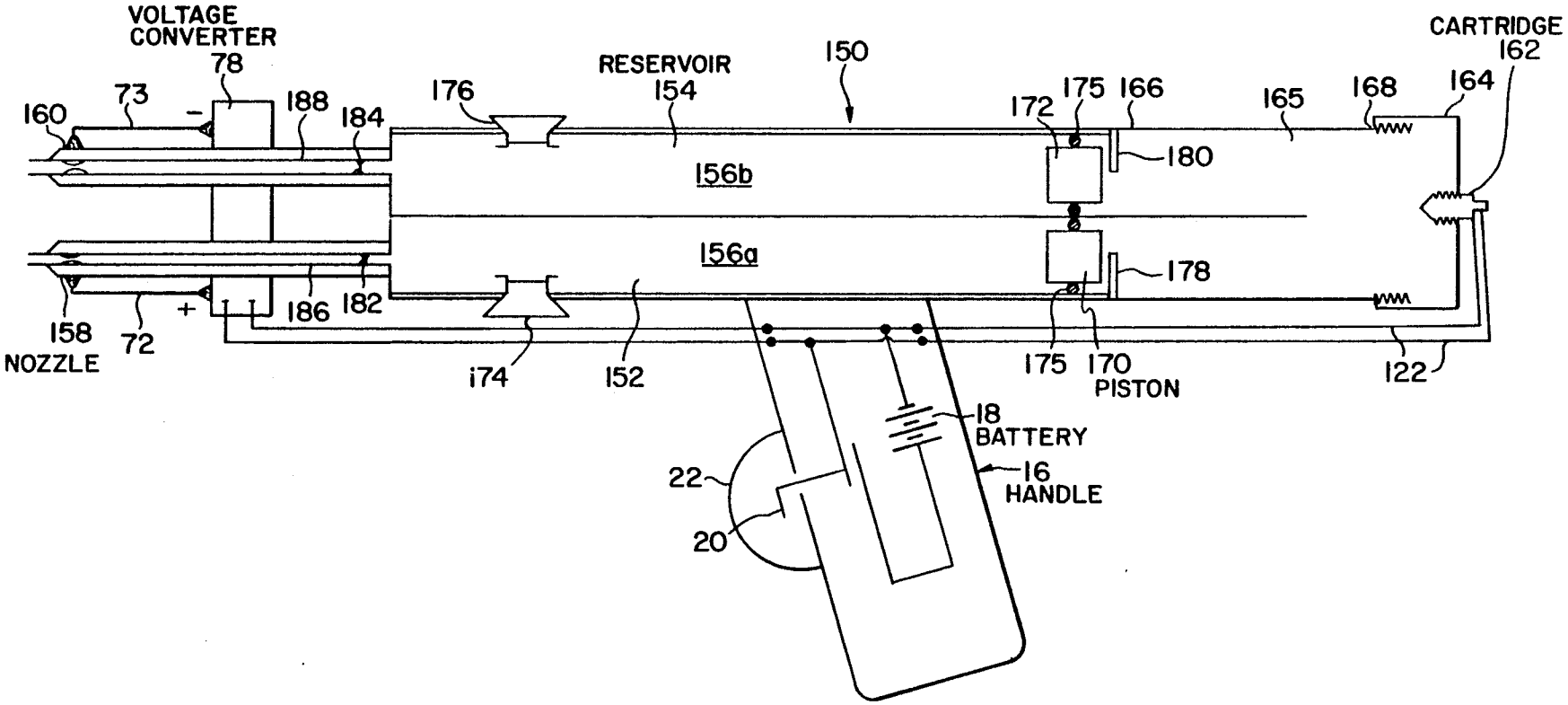
FIG. 3 is yet another such view showing a further embodiment of a stun gun with a modified fluid ejection means.

FIG. 3 shows a further embodiment 150 of a self-defense device in accordance with the present invention. Like the embodiments of FIGS. 1 and 2, the device 150 generates and ejects from the nozzles 158, 160 dual liquid streams electrically charged at different potentials, e.g. negative and positive, via wires 72, 73 from voltage converter 78 for achieving the stun effect described above in connection with the device 50 of FIG. 1. Structurally, the device 150 of FIG. 3 is closer to the device 50 of FIG. 1 than the device 100 of FIG. 2, in that the device 150 employs dual reservoirs 152, 154 each containing a conductive fluid **156*a* and 156*b*, respectively. However, the device 150 differs from the other embodiments in that it employs an alternative mechanism for discharging liquid from the reservoirs 152, 154 through the metal nozzles 158, 160. In particular, the device 150 incorporates an electrically actuated cartridge 162** which, upon activation, releases a reactive material that builds pressure on a piston which forces fluid from the reservoir.

As shown, the cartridge 162 is mounted in the end cover 164, which is itself mounted on the main housing 166 of the device 150 as by screw threads 168. Wires 122 connect the cartridge 162 to the battery 18 such that the cartridge is activated and the reactive material therein released when the switch 20 is depressed.

The reservoirs 152, 154 include filling ports 174, 176, respectively, but do not include the vents found in the other embodiments. At the proximal end of each reservoir 152, 154 is a piston 170, 172 freely slidable in the chamber defined by its respective reservoir. For this purpose, the reservoirs 152, 154 and their respective pistons 170, 172 are preferably of circular cross-section, with a tight seal between the pistons and the walls of their seal between the pistons and the walls of their respective reservoirs being assured as by the inclusion of o-rings 175 seated in grooves on the walls of the pistons.

To use the device 150 of FIG. 3, the end cover 164 is removed whereupon the reservoirs 152, 154 are filled with conductive fluid 173 via filling ports 174, 176, respectively. As filling occurs, the pistons 170, 172 are moved to their proximal positions (solid lines in FIG. 3) under the pressure of the incoming liquid, with stops 178, 180 defining the most proximal positions of the pistons in their respective reservoir chambers. "Blow-out" plugs 182, 184 in barrels 186 and 188, respectively, retain the fluid 156 in the reservoirs 152, 154 until the device 150 is actuated.

The device 150 is actuated in the usual fashion, i.e., by depressing the trigger 20. Upon depression of the trigger 20, positive and negative voltage potentials are applied to the metal nozzles 158 and 160, respectively, in the manner more fully described above in connection with the embodiment of FIG. 1. At the same time, depression of trigger 20 actuates the cartridge 162 for releasing a reactive material in the chamber 174 between the end cover 164 and pistons 170, 172. The pressure buildup in the chamber 165 caused by the release of the reactive material forces the pistons 170, 172 toward the distal ends of their respective reservoir chambers, thereby forcing the fluid 156 into barrels 186, 188. At this point, the pressure buildup in the barrels 186, 188 disintegrates the plugs 182, 184 whereupon the fluids **156*a* and 156*b* are expelled through the nozzles 158, 160. The stun effect is the same as that described above in connection with the embodiment of FIG. 1, i.e., the assailant experiences an electric shock as the dual streams strike. Of course, the use of a cartridge 162** and associated elements in lieu of a pump for expelling fluid from the reservoir is equally applicable to the other embodiments of the invention described herein.

In place of blow out plugs 182, 184, flap valves such as typically shown in FIG. 3(*a*) and FIG. 3(*b*) may be employed, in which event the device 150 is more readily reusable, i.e., by simply refilling the reservoirs 152, 154 and inserting a new cartridge 162. Of course, if disintegrating plugs 182, 184 are used, it is essential that they disintegrate to a sufficiently fine particle size to prevent blockage of the venturis in nozzles 158, 160.

In place of the cartridge activated fluid projecting system of FIG. 3, in an alternate embodiment of FIG. 4 a spring-loaded ram assembly 190 is incorporated into the overall design of FIG. 3 to provide a fluid projecting system with reloading capacity. The spring loaded ram assembly is driven by a solenoid 192 or by a mechanical linkage **192*a*. The ram assembly is resettable and is actuated by the trigger 20. The ram assembly supplies the required force for projecting fluid by displacing dual plungers which in turn activate dual syringes 152*a*, 154*a* by displacing pistons 170*a*, 172*a* within the dual syringes. Liquid is thereby forced through barrels 186, 188 and projected from nozzles 158, 160. The dual syringes are mounted in chambers located, for example, where reservoirs 152, 154 are located in FIG. 3. The spring loaded ram assembly is located rearwardly, relative to the nozzles, of the dual syringes 152*a*, 154*a*. The syringes each include a cylinder housing a piston 170*a*, 172*a* which is mounted to a shaft 173*a*, 175*a***, the shaft extending rearwardly of the cylinder. In operation, the shaft is pushed forward by a plunger, thereby moving the piston forward within the cylinder to expel fluid from the syringe and project it through the nozzles at a target. The syringes are replaceable and refillable.

While a detailed description of certain preferred embodiments of the present invention has been provided, it should be understood that still further variations, changes and modifications may be made without departing from the spirit and scope of the invention. If desired, the battery and/or voltage converter and/or reservoir(s) may be mounted in a separate housing and attached via suitable electrical and/or fluid conducting means. Any fluid expulsion means capable of generating a continuous fluid stream may be employed, e.g. electrical, mechanical, stored gas, etc. or any combination thereof.

Electro-luminescent, phosphorescent, or chemi-luminescent materials may be incorporated into the fluid to render fluid streams light emitting in transit to the target. Dual streams may be rendered light emitting in transit, or upon contact with the target and mixing of the streams, or both. These materials, some of particulate nature, others fluid soluble, may be incorporated either directly into the contained fluid, or admitted to a fluid stream via downstream plumbing if binary mixing be required, to produce the phosphorescent fluid streams. Examples of particulate material that can exhibit electro-luminescence and/or phosphorescence are copper or other metal activated zinc sulfide powder. Examples of fluid soluble chemi-luminescent materials include Luminol or Leuciginine based systems which, when mixed with oxidation capable secondary substances (e.g. peroxide), cause these materials to brightly phosphoresce. The fluid may contain a liquid base which is flammable, thus providing incendiary or explosive capability. Dyes and irritants and other incapacitating agents may also be added to the fluid.

As the foregoing as well as additional changes and modifications will be apparent to persons of ordinary skill in the art, the above description should be construed as illustrative and not in a limiting sense, the scope of the invention being defined by the following claims.

I claim:

1. A portable device for ejecting continuous streams of electrically charged fluids at a target, comprising:

an electrically non-conductive housing having a first metal nozzle defining a first fluid ejection orifice and a second metal nozzle defining a second fluid ejection orifice, and first conduit means defining a first path for a flow of fluid from a reservoir through a first barrel to said first fluid ejection orifice and second conduit means defining a second path for a flow of fluid from a reservoir through a second barrel to said second fluid ejection orifice;

means for forcing fluid in said first path through said first ejection orifice in a continuous stream of first fluid to a target and for forcing fluid in said second path through said second ejection orifice in a continuous stream of second fluid to said target; means for causing said streams to be electrically conductive;

a high voltage power source comprising in electrical circuit a battery power supply and a voltage converter in said housing, said voltage converter being mounted on at least said first barrel and in electrically conducting relation with said first and second metal nozzles for imparting a high voltage electrical charge at a first potential to said first fluid exiting said first ejection nozzle and at a different potential to said second fluid exiting said second ejection nozzle; and electrically actuatable means comprising a switch in electrical circuit with said battery for energizing said voltage converter and simultaneously electrically activating said means for forcing fluid through said ejection orifices and ejecting continuous streams of electrically charged first and second fluids at said target.

2. The device according to claim 1, wherein the fluid flow to said first barrel and the fluid flow to said second barrel are electrically non-conductive;

and wherein said means for causing is disposed in said first path and in said second path for rendering the fluids therein electrically conductive.

3. A portable device for ejecting continuous streams at a target, comprising:

a housing defining a first fluid ejection orifice and a second fluid ejection orifice;

a reservoir containing liquid;

means defining a first fluid path from said reservoir to said first fluid ejection orifice and a second fluid path from said reservoir to said second fluid ejection orifice;

means for adding one or more materials to the fluid in at least one of said fluid paths; and electrically actuatable means for forcing fluid from the reservoir simultaneously through both said first and second fluid paths and for ejecting a continuous stream from each of said first and second fluid ejection orifices at a target.

4. A device according to claim 3, wherein said means for adding material comprises electrolyte material and means for retaining such material in said fluid paths and for accomodating liquid flow therethrough.

5. A device according to claim 3, wherein said means for adding material comprises material from the class consisting of electro-luminescent, phosphorescent and chemi-luminescent materials.

6. A device according to claim 3, wherein said means for adding material comprises material from the class consisting of dyes, irritants and incapacitating agents.

7. A portable device for ejecting continuous streams of fluids oppositely charged at high voltage at a target, comprising:

a housing defining a first fluid ejection orifice and a second fluid ejection orifice, said housing being electrically non-conductive and said orifices being comprised in metal nozzles;

a reservoir containing electrically non-conductive fluid;

means defining a first fluid path from said reservoir to said first fluid ejection orifice and a second fluid path from said reservoir to said second fluid ejection orifice;

means disposed in said first fluid path for rendering the non-conductive fluid electrically conductive in the path therefrom to the first fluid ejection orifice;

means disposed in said second fluid path for rendering the non-conductive fluid electrically conductive in the path therefrom to the second fluid ejection orifice;

a high voltage power source for supplying opposing high voltage electric charges one of which is in electrically conducting relation with said first fluid ejection orifice and the opposing charge is in electrically conducting relation with said second fluid ejection orifice;

electrically actuatable means for forcing fluid from the reservoir simultaneously through said first fluid ejection orifice and said second fluid ejection orifice and for ejecting from said orifices continuous fluid streams and establishing an electric current path between said streams at the target.

8. The device according to claim 7, further comprising means disposed in said first and second fluid paths for blocking fluid flow from said reservoir to said orifices and for accomodating said fluid flow in response to actuation of said fluid forcing means.

9. The device according to claim 7, wherein said fluid reservoir, said power source and said fluid forcing means are disposed in said housing, and said housing is adapted to be hand held.

10. The device according to claim 7, wherein said fluid forcing means comprises a piston disposed for sliding movement in said reservoir in sealing relation with the walls thereof; wherein said housing defines a chamber behind said piston; and actuatable pressure generating means disposed in communication with said chamber whereby, when said pressure generating means is actuated, said piston is forced into said reservoir for ejecting fluid through said orifice.

11. The device according to claim 7, wherein said fluid forcing means comprises a piston slidably disposed in said reservoir and means for moving said piston through said reservoir for expelling fluid therefrom.

12. The device according to claim 11, wherein said means for moving said piston comprises said housing defining a chamber behind said piston and a cartridge housing a reactive material releasable into said chamber.

13. The device according to claim 7, wherein said high voltage power source comprises a direct current low voltage supply and said voltage converter comprises means for converting said low voltage to a high voltage.

14. The device according to claim 7, wherein said housing has the configuration of a gun.

15. The device according to claim 7, further comprising:

means which maximizes the electrical potential of said high voltage charges transferrable to said target.

16. The device according to claim 7, further comprising means for admitting light emitting material of the class consisting of electroluminescent, phosphorescent or chemi-luminescent materials into at least said first fluid path.

17. The device according to claim 7, further comprising:

means for admitting an incapacitating agent, including but not limited to materials comprising dyes and irritants, into at least said first fluid path.

18. The device according to claim 7, further comprising:

venturis in said orifices set on an angle for directing said first and second fluid streams to achieve optimal distances between them when they contact the target.

19. The device according to claim 7, further comprising: means disposed in the reservoir for blocking fluid flow from the reservoir to said first and second fluid paths and for accomodating said fluid flows in response to actuation of said fluid forcing means.

20. The device according to claim 7, wherein said means for forcing fluid comprises a pump.

21. The device according to claim 7, wherein said means for forcing fluid comprises pump means disposed in said fluid paths.

* * * * *